US006905023B2

(12) United States Patent
Au

(10) Patent No.: US 6,905,023 B2
(45) Date of Patent: Jun. 14, 2005

(54) CONTAINER WITH ACTION CONFIGURATION

(75) Inventor: Kinsen Ka Fai Au, Tuen Mun (HK)

(73) Assignee: Nationalpak Limited (HK)

( * ) Notice: Subject to any disclaimer, the term of this patent is extended or adjusted under 35 U.S.C. 154(b) by 219 days.

(21) Appl. No.: 10/318,648

(22) Filed: Dec. 16, 2002

(65) Prior Publication Data

US 2004/0112782 A1 Jun. 17, 2004

(51) Int. Cl.[7] ..... B65D 73/00

(52) U.S. Cl. ..... 206/457; 206/566; 40/414; 40/417

(58) Field of Search ..... 206/457, 6.1, 566; 40/312, 411, 414, 417; 220/315, 324, 326; D9/307, 310; D3/201, 270, 235, 304; 221/45

(56) References Cited

U.S. PATENT DOCUMENTS 1,579,613 A * 4/1926 Holmes ..... 40/413
3,178,054 A * 4/1965 Lindecker ..... 221/58
4,574,952 A * 3/1986 Masui ..... 206/494
5,699,912 A * 12/1997 Ishikawa et al. ..... 206/494
6,585,131 B2 * 7/2003 Huang et al. ..... 221/48

* cited by examiner

*Primary Examiner*—Jacob K. Ackun
*Assistant Examiner*—J Williams
(74) *Attorney, Agent, or Firm*—Raymond Y. Chan; David and Raymond

(57) ABSTRACT

A container includes a container body having an opening and a storage cavity for receiving an ornamental object therein and a container cover covering on the opening of the container so as to enclose the storage cavity thereof. The container cover has a display window provided thereon and includes a window cover having at least an action lip movably mounted on the container cover and arranged to fold between a display position and a storage position, wherein at the display position, the action lip of the window cover is opened with respect to the display window so that the storage cavity is allowed to be viewed from outside through the display window for displaying the ornamental object, and at the storage position, the action lip of the window cover is covered on the display window for further securing the ornamental object in the storage cavity.

20 Claims, 3 Drawing Sheets

CONTAINER WITH ACTION CONFIGURATION

BACKGROUND OF THE PRESENT INVENTION

1. Field of Invention

The present invention relates to a container, and more particularly to a container which comprises a window cover having an action configuration for covering on a display window provided on a container cover, so as to not only protectively display an ornamental object stored in the container without opening the container cover but also enhance the ornamental appearance of the container.

2. Description of Related Arts

The appearance of ornamental objects such as jewelries and watches are critical for attaching customers' attention. As more and more designers provided variety of designs for customers to choose. Therefore, for each jewelry store, the amount for each design is limited. And the exact shape and size of each jewelry and watch is differently for each other. It is not economical to use different container for displaying, packaging, and storage. Not to mention it will spend store staff extra time for transfer the items for displaying container to package containers. It is desirable to use a container suitable for display and package.

There are two types of conventional displayable box. In one type, the cover is hingely connected to the base, opening and closing the box will take extra effort and may be unsafe. In addition, such displayable box will waste lots of displaying space since the cover must be flipped upwardly to display the ornamental object in the base.

In another type, the cover can be separated from the box. While the product is displayed, the cover is separated from its box. Since the cover is not connected to the box, it is easy to lose the cover.

Furthermore, the two types of conventional displayable box have a common drawback that the cover must be opened with respect to the base such that not only the dust or dirt may enter into the base so as to destroy the aesthetic appearance of the ornamental object therein but also the displayable box cannot protect the ornamental object while displaying.

The present invention has overcome the disadvantages of both types of the displayable box, the ornamental object can be protected in displayable box and displayed without opening the cover so as to eliminate the possibility of getting lost of the cover. Especially, for expensive jewelries or watches that need more protection and to be handled with care, the present invention will be very useful.

SUMMARY OF THE PRESENT INVENTION

A main object of the present invention is to provide a container which comprises a window cover having an action configuration for covering on a display window provided on a container cover, so as to not only protectively display an ornamental object stored in the container without opening the container cover but also enhance the ornamental appearance of the container.

Another object of the present invention is to provide a container, wherein the window cover is capable of being opened so that the ornamental object in the container can be displayed through the display window on the container cover. In other words, the container does no require opening the container cover for display purpose, so as to prevent the ornamental object from getting dusty.

Another object of the present invention is to provide a container, wherein the window cover can be shaped to have any kind of the action configuration for matching the ornamental object so as to further enhance the attraction thereof.

Another object of the present invention is to provide a container, wherein the display operation of the container is simple and easy by simply folding up the window cover with respect to the container cover.

Another object of the present invention is to provide a container, wherein no expensive or complicated structure is required to employ in the present invention in order to achieve the above mentioned objects. Therefore, the present invention successfully provides an economic and efficient solution for not only providing a secure configuration of the container to store the ornamental object but also enhancing the appearance container to promote the ornamental object therein.

Accordingly, in order to accomplish the above objects, the present invention provides a container, comprising:

a container body having an opening and a storage cavity for receiving an ornamental object therein; and a container cover covering on the opening of the container so as to enclose the storage cavity thereof, wherein the container cover has a display window provided thereon and comprises a window cover having at least an action lip movably mounted on the container cover and arranged to fold between a display position and a storage position, wherein at the display position, the action lip of the window cover is opened with respect to the display window so that the storage cavity is allowed to be viewed from outside through the display window for displaying the ornamental object, and at the storage position, the action lip of the window cover is covered on the display window for further securing the ornamental object in the storage cavity.

These and other objectives, features, and advantages of the present invention will become apparent from the following detailed description, the accompanying drawings, and the appended claims.

DETAILED DESCRIPTION OF THE PREFERRED EMBODIMENT

Figure 1:
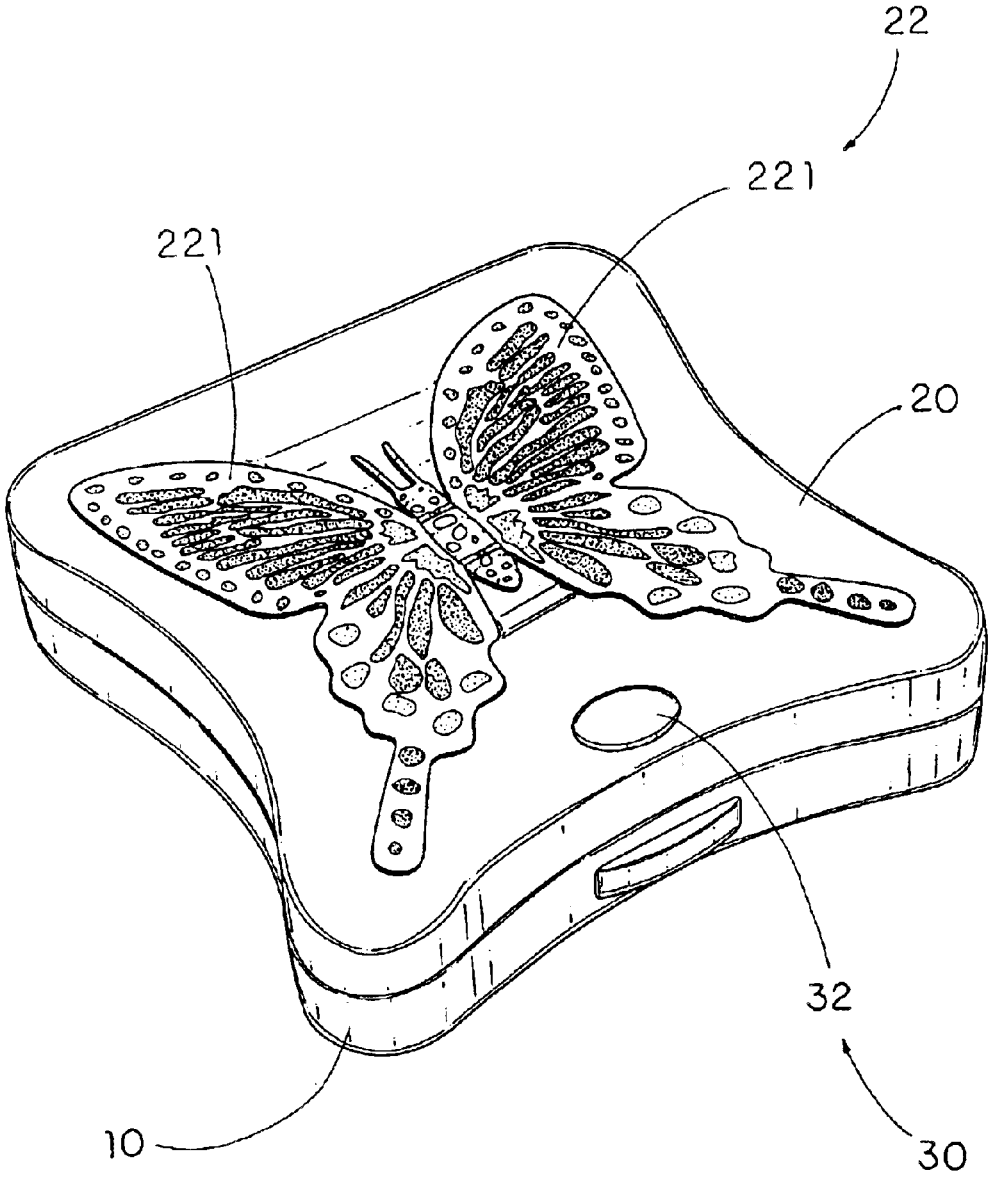
FIG. 1 is a perspective view of a container with an action configuration in a storage position according to a preferred embodiment of the present invention.

Referring to FIG. 1 of the drawings, a container according to a preferred embodiment of the present invention is illustrated, wherein the container comprises a container body 10 having an opening 11 and a storage cavity 12 for receiving an ornamental object A therein, and a container cover 20 covering on the opening 11 of the container 10 so as to enclose the storage cavity 12 thereof.

The container cover 20 has a display window 21 provided thereon and comprises a window cover 22 having an action lip 221 movably mounted on the container cover 20 and arranged to fold between a display position and a storage position, wherein at the display position, the action lip 221 of the window cover 21 is opened with respect to the display window 21 so that the storage cavity 12 is allowed to be viewed from outside through the display window 21 for displaying the ornamental object A, and at the storage position, the action lip 221 of the window cover 22 is covered on the display window 21 for further securing the ornamental object A in the storage cavity 12.

According to the preferred embodiment, the container cover 20 can be detachably or pivotally mounted on the container body 10 as a conventional container to securely store the ornamental object A since the container cover 20 does not require to be opened with respect to the container body 10 at the display position.

The display window 21 is provided on the container cover 20 such that when the ornamental object A is stored in the storage cavity 12 of the container body 10, the ornament object A can be viewed from outside through the display window 21.

Accordingly, the display window 21 is shaped corresponding to the action lip 221 of the window cover 22 in such a manner that when the action lip 221 of the window cover 22 is fittedly covered on the display window 21, the action configuration of the window cover 22 can formed as a decoration for the container.

The container cover 20 further comprises a transparent protective shelter 23 provided on the display window 21 at an inner side of the container cover 20 such that the action lip 221 of the window cover 22 is supported on the protective shelter 23 at the storage position. The protective shelter 23 is made of transparent material, such as glass or plastic, in such a manner that the ornamental object A can be viewed from outside through the protective shelter 23 at the display position while the protective shelter 23 can prevent the ornamental object A in the storage cavity 12 from getting dusty.

Figure 3:
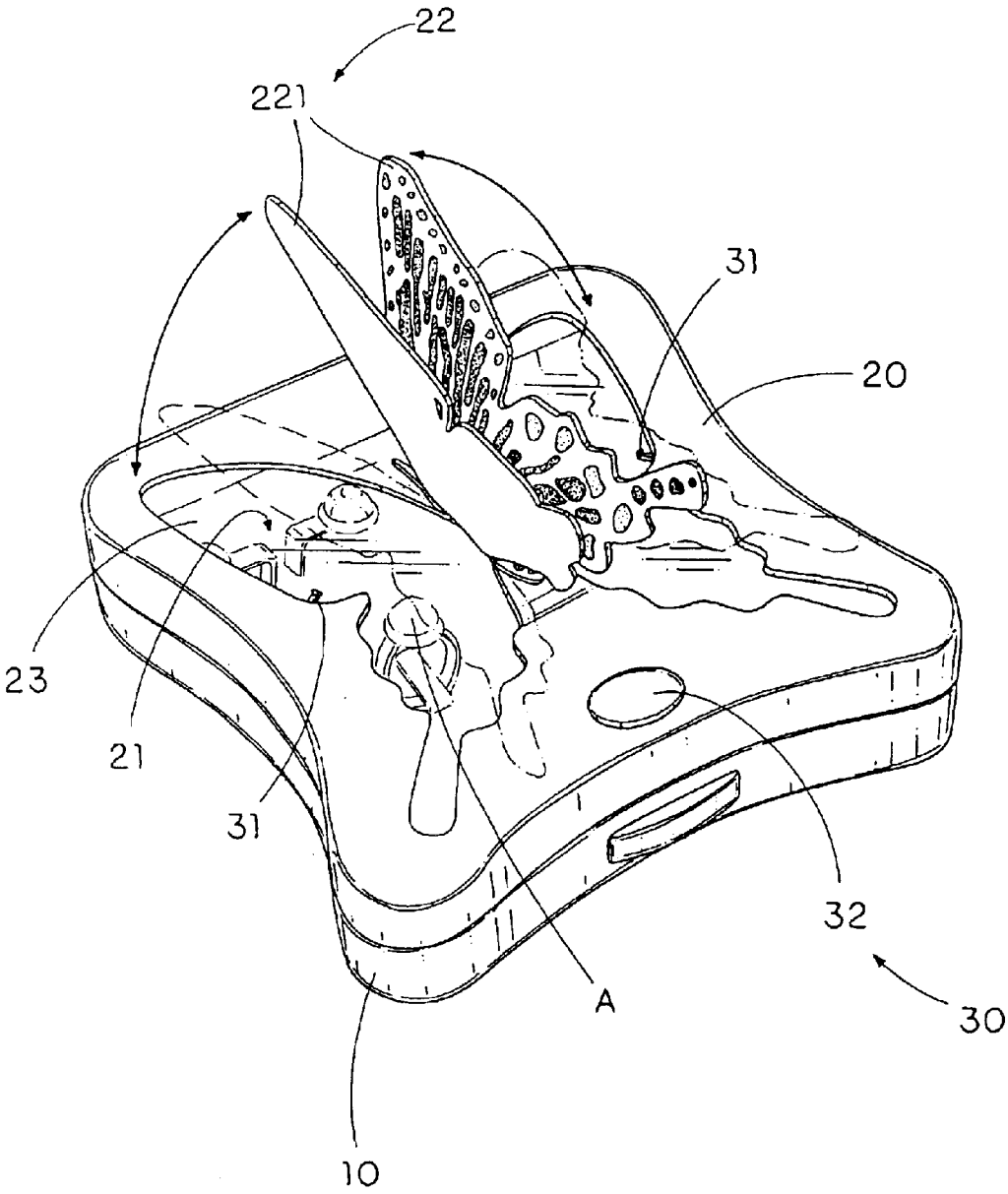
FIG. 3 is a perspective view of the container with an action configuration in a display position according to the above preferred embodiment of the present invention.

As shown in FIGS. 1 and 3, the window cover 22 is shaped as a butterfly figure, wherein the two wings of the butterfly are embodied as the action lip 221 of the window cover 22 pivotally connected with each other on the container cover 20 in such a manner that the action lip 221 of the window cover 22 are pivotally and upwardly folded with respect to the container cover 20 so as to expose the ornamental object A through the display window 21.

The container further comprises means 30 for locking the action lip 221 of the window cover 21 at the storage position so as to enclose the display window 21. The locking means 30 comprises a locking latch 31 extended from the container cover 20 to engage with an engaging portion of the action lip 221 of the window cover 21 at the storage position so as to lock up the action lip 221 of the window cover 21 on the container cover 20 and a control button 32 provided on the container cover 20 and arranged to release the locking up of the locking latch 31 with the window cover 21 so that the action lip 221 of the window cover 21 is capable of folding to the display position.

Figure 2:
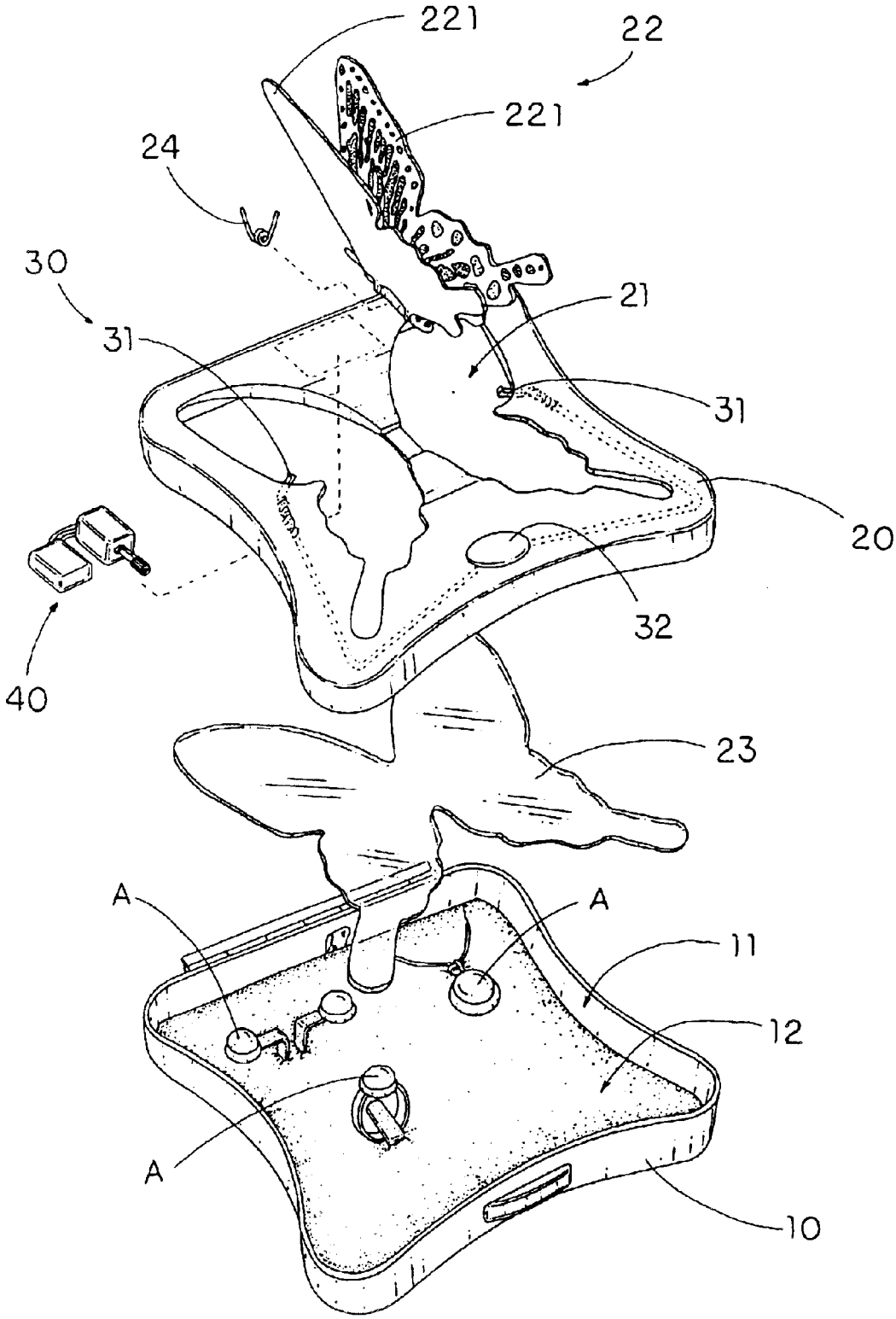
FIG. 2 is an exploded perspective view of the container with an action configuration according to the above preferred embodiment of the present invention.

The container cover 20 further comprises a resilient element 24 mounted to the action lip 221 of the window cover 22 at a pivot joint thereof for applying an urging pressure against the action lip 221 of the window cover 22 so as to normally urge and retain the action lip 221 of the window cover 22 at the display position. As shown in FIG. 2, the resilient element 24 is a coil spring, according to the preferred embodiment, supported on the container cover 20 and having two ends biasing against the wings of the butterfly figure of the window cover 22 so as to push the wings of the butterfly figure upwardly to expose the display window 21 to outside.

As shown in FIG. 2, the container further comprises means 40 for transmitting a motion to the action lip 221 of the window cover 22 to move between the storage position and the display position. Accordingly, the transmitting means 40 can be a lip motion arrangement which comprises a motor supported by the container cover 20 and electrically connected to a power source for driving the action lip 221 of the window cover 22 to move, and a switch provided on the container cover 22 and arranged to activate the motor so as to provide an action motion of the action lip 221 of the window cover 22 with respect to the container cover 22.

The motor comprises a driving shaft rotatably extended to the pivot joint of the action lip 221 of the window cover 22 in such a manner that when the motor is switched on, the action lip 221 of the window cover 22 is pivotally moved about the pivot joint through the driving shaft, so as to provide the action motion of the window cover 22.

Accordingly, the two wings of the butterfly figure, which are embodied as the action lip 221 of the window cover 22 according to the preferred embodiment, are pivotally swinging on the container cover 20 through the transmitting means 40, as shown in FIG. 3.

Since the container according to the above preferred embodiment provides the window cover on the container cover, the container cover does not have to be opened to display the ornamental object in the storage cavity of the container body, so that the ornamental object can be securely protected by the container cover. In addition, the window cover can be shaped to have any kind of the action configuration for matching the ornamental object so as to not only further enhance the attraction of the ornamental object but also form as a decoration of the container cover.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity, wherein said display window is shaped corresponding to said action lip of said window cover in such a manner that when said action lip of said window cover is fittedly covered on said display window, said window cover forms as a decoration for said container; and means for transmitting a motion to said action lip of said window cover to move between said storage position and said display position.

2. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity, wherein said display window is shaped corresponding to said action lip of said window cover in such a manner that when said action lip of said window cover is fittedly covered on said display window, said window cover forms as a decoration for said container, wherein said container cover further comprises a transparent protective shelter protective shelter provided on said display window at an inner side of said container cover such that said action lip of said window cover is supported on said protective shelter at said storage position; and means for transmitting a motion to said action lip of said window cover to move between said storage position and said display position.

3. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity, wherein said display window is shaped corresponding to said action lip of said window cover in such a manner that when said action lip of said window cover is fittedly covered on said display window, said window cover forms as a decoration for said container, wherein said container cover further comprises a transparent protective shelter protective shelter provided on said display window at an inner side of said container cover such that said action lip of said window cover is supported on said protective shelter at said storage position;

means for transmitting a motion to said action lip of said window cover to move between said storage position and said display position; and means for locking said action lip of said window cover at said storage position to enclose said display window.

4. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity, wherein said display window is shaped corresponding to said action lip of said window cover in such a manner that when said action lip of said window cover is fittedly covered on said display window, said window cover forms as a decoration for said container, wherein said container cover further comprises a transparent protective shelter protective shelter provided on said display window at an inner side of said container cover such that said action lip of said window cover is supported on said protective shelter at said storage position;

means for transmitting a motion to said action lip of said window cover to move between said storage position and said display position; and means for locking said action lip of said window cover at said storage position to enclose said display window, wherein said locking means comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

5. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity, wherein said display window is shaped corresponding to said action lip of said window cover in such a manner that when said action lip of said window cover is fittedly covered on said display window, said window cover forms as a decoration for said container, wherein said container cover further comprises a transparent protective shelter protective shelter provided on said display window at an inner side of said container cover such that said action lip of said window cover is supported on said protective shelter at said storage position, wherein said action lip of said window cover is pivotally mounted on said container cover by a pivot joint, wherein said container cover further comprises a resilient element provided at said pivot joint for applying an urging pressure against said action lip of said window cover so as to normally urge and retain said action of said window cover at said display position;

means for transmitting a motion to said action lip of said window cover to move between said storage position and said display position; and means for locking said action lip of said window cover at said storage position to enclose said display window, wherein said locking means comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

6. A container, comprising:

a container body having an opening and a storage cavity for receiving an ornamental object therein;

a container cover covering on said opening of said container to enclose said storage cavity thereof, wherein said container cover has a display window provided thereon and comprises a window cover having at least an action lip movably mounted on said container cover and arranged to fold between a display position and a storage position, wherein at said display position, said action lip of the window cover is opened with respect to said display window so that said storage cavity is allowed to be viewed from outside through said display window for displaying said ornamental object, and at said storage position, said action lip of said window cover is covered on said display window for further securing said ornamental object in said storage cavity; and a transmitting device for transmitting a motion to said action lip of said window cover to move between said storage position and said display position, wherein said transmitting device comprises motor supported by said container cover to drive said action lip of said window cover to move, and a switch provided on said container cover to activate said motor so as to provide an action motion of said action lip of said window cover with respect to said container cover.

7. The container, as recited in claim 6, wherein said motor comprises a driving shaft rotatably extended to a pivot joint of said action lip of said window cover in such a manner that when said motor is switched on, said action lip of said window cover is pivotally moved about said pivot joint through said driving shaft, so as to provide said action motion of said window cover.

8. The container, as recited in claim 6, wherein said display window is shaped corresponding to said action lip of said window cover in such a manner that when said action lip of said window cover is fittedly covered on said display window, said window cover forms as a decoration for said container.

9. The container, as recited in claim 7, wherein said display window is shaped corresponding to said action lip of said window cover in such a manner that when said action lip of said window cover is fittedly covered on said display window, said window cover forms as a decoration for said container.

10. The container, as recited in claim 7, wherein said container cover further comprises a resilient element provided at said pivot joint for applying an urging pressure against said action lip of said window cover so as to normally urge and retain said action of said window cover at said display position.

11. The container, as recited in claim 9, wherein said container cover further comprises a resilient element provided at said pivot joint for applying an urging pressure against said action lip of said window cover so as to normally urge and retain said action of said window cover at said display position.

12. The container, as recited in claim 6, wherein said container cover further comprises a transparent protective shelter protective shelter provided on said display window at an inner side of said container cover such that said action lip of said window cover is supported on said protective shelter at said storage position.

13. The container, as recited in claim 7, wherein said container cover further comprises a transparent protective shelter protective shelter provided on said display window at an inner side of said container cover such that said action lip of said window cover is supported on said protective shelter at said storage position.

14. The container, as recited in claim 9, wherein said container cover further comprises a transparent protective shelter protective shelter provided on said display window at an inner side of said container cover such that said action lip of said window cover is supported on said protective shelter at said storage position.

15. The container, as recited in claim 11, wherein said container cover further comprises a transparent protective shelter protective shelter provided on said display window at an inner side of said container cover such that said action lip of said window cover is supported on said protective shelter at said storage position.

16. The container, as recited in claim 6, further comprising a locking device for locking said action lip of said window cover at said storage position to enclose said display window, wherein said locking device comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

17. The container, as recited in claim 7, further comprising a locking device for locking said action lip of said window cover at said storage position to enclose said display window, wherein said locking device comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

18. The container, as recited in claim 9, further comprising a locking device for locking said action lip of said window cover at said storage position to enclose said display window, wherein said locking device comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

19. The container, as recited in claim 11, further comprising a locking device for locking said action lip of said window cover at said storage position to enclose said display window, wherein said locking device comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

20. The container, as recited in claim 15, further comprising a locking device for locking said action lip of said window cover at said storage position to enclose said display window, wherein said locking device comprises a locking latch extended from said container cover to engage with an engaging portion of said action lip of said window cover at a said storage position so as to lock up said action lip of said window cover on said container cover, and a control button provided on said container cover and arranged to release a locking up said locking latch with said window cover so that said action lip of said window cover is capable of folding to said display position.

* * * * *